United States Patent [19]

Stafford et al.

[11] 4,388,531

[45] Jun. 14, 1983

[54] IONIZER HAVING INTERCHANGEABLE IONIZATION CHAMBER

[75] Inventors: George C. Stafford; David R. Stephens, both of San Jose, Calif.

[73] Assignee: Finnigan Corporation, Sunnyvale, Calif.

[21] Appl. No.: 241,083

[22] Filed: Mar. 6, 1981

[51] Int. Cl.[3] ..... H01J 27/00

[52] U.S. Cl. ..... 250/427; 250/423 R

[58] Field of Search ..... 250/288, 423, 427; 313/231.01

[56] References Cited

U.S. PATENT DOCUMENTS

| | | | |
|---|---|---|---|
| 3,115,591 | 12/1963 | Brünnée | 250/423 |
| 3,886,365 | 5/1975 | Kruger et al. . | |
| 4,157,471 | 6/1979 | Mlekudaj | 250/423 |
| 4,266,127 | 5/1981 | Chang | 250/423 |

*Primary Examiner*—Bruce C. Anderson

*Attorney, Agent, or Firm*—Flehr, Hohbach, Test, Albritton & Herbert

[57] ABSTRACT

An ionizer adapted to be placed in a vacuum envelope for providing ions of a sample to be analyzed is disclosed herein and includes an electron source, ion accelerating and focusing electrodes and an interchangeable ionization chamber including a first opening for allowing electrons to enter the chamber and an exit opening to allow ions to exit said chamber. The ionization chamber is supported in cooperative relationship with the electron source and accelerating and focusing electrodes whereby electrons enter the chamber through the first opening and form sample ions in the chamber which then exit the chamber through the exit opening toward said accelerating and focusing electrodes.

10 Claims, 12 Drawing Figures

IONIZER HAVING INTERCHANGEABLE IONIZATION CHAMBER

This invention relates to ionizers employed in mass spectrometers and more particularly to an ionizer having interchangeable ionization chambers.

There are currently two principle types of ionizers used with quadrupole mass spectrometers. These are the electron impact (EI) type and the chemical ionization (CI) type in each of these ionizers ionization takes place in a bounded volume which includes openings for the entrance of electrons which impact with the substances to generate ions and openings through which the generated ions exit to be accelerated and focused into an associated mass spectrometer. Generally, chemical ionization is carried out at relatively high pressure ($\sim 1$ torr) where ion molecule collisions are likely; the electron beam openings and ion exit openings are small in CI. In the electron impact method, the pressure is low ($<10^3$ torr) and the openings are larger. Electron impact and chemical ionization is described in Techniques of Combined Gas Chromatography/Mass Spectrometry by William McFadden, John Wiley and Sons, 1973.

In both types of ionization, it is extremely important that the ionization chamber or ion volume in which the ions are formed to clean for proper ion focusing or detection. However, through repeated ionization of samples the chamber will become contaminated by the collection of ions and molecules on the surface. This reduces the sensitivity. In the prior art this has necessitated the removal of the entire assembly and cleaning thereof. This is a time consuming procedure and during such procedure the mass spectrometer assembly is out of service.

If both types of ionization is desired in an ionizer the size and configuration of the ionization chamber must be compromised. The mass spectrometer will not provide optimum performance in both modes of operation. Where optimum performance is required the mass spectrometer is taken out of service to install the proper ionizer to provide either electron impact ionization or chemical ionization.

In U.S. Pat. No. 3,886,365, there is described an ionizer in which the ionization chamber configuration is changed, moving certain parts of the chamber to provide the appropriate configurtions for each type of ionization. However, the contamination problem is still present.

It is an object of the present invention to provide an ionizer which has interchangeable ionization chambers (ion volumes).

It is another object of the present invention to provide an ionizer which has interchangeable, inexpensive, disposable ionization chambers.

It is a further object of the present invention to provide an ionizer into which interchangeable ionization chambers are inserted by a probe which releasably holds the ionization chamber.

It is another object of the present invention to provide an ionizer in which interchangeable ion volumes for optimizing in a single ionizer electron impact ionization and chemical ionization.

It is another object of the present invention to provide an ionizer assembly with interchangeable ionization chambers which can be interchanged without breaking the vacuum in the system in which the ionizer is being used.

The foregoing and other objects of the invention are achieved by an ionizer assembly which includes an electron source and an electrode assembly and means for removably supporting an interchangeable ionization chamber or ion volume in cooperative relationship with the electron source and electrode assembly. There is also provided a disposable ionization chamber and a probe for inserting and removing the ionization chamber from the ionizer.

The invention will be understood from the following description and accompanying drawings in which FIG. 1 is an elevational view of an ionizer assembly in accordance with the present invention.

Figure 1:
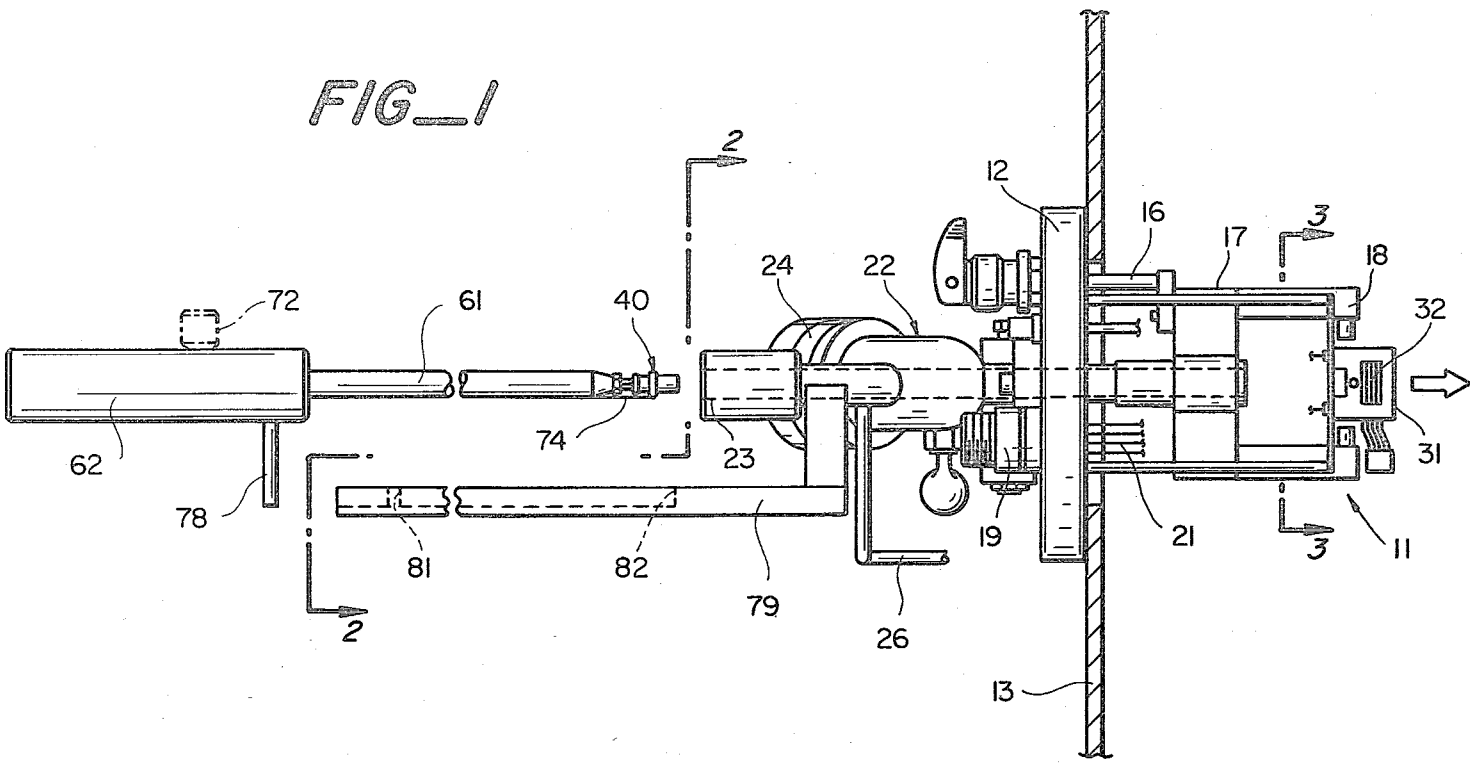
Figure 2:
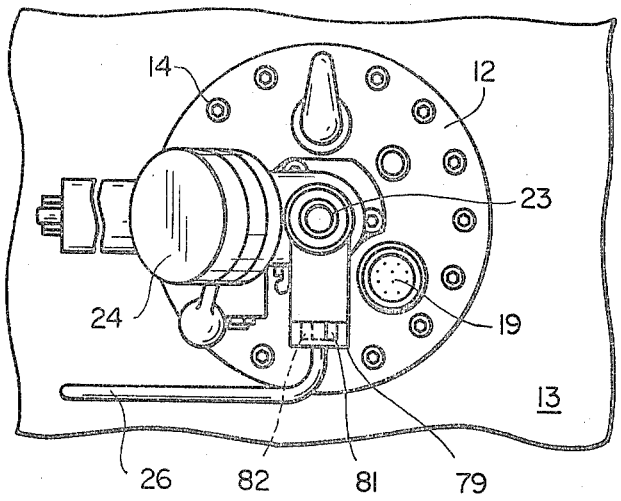
FIG. 2 is a view taken generally along the line 2—2 of FIG. 1.
Figure 3:
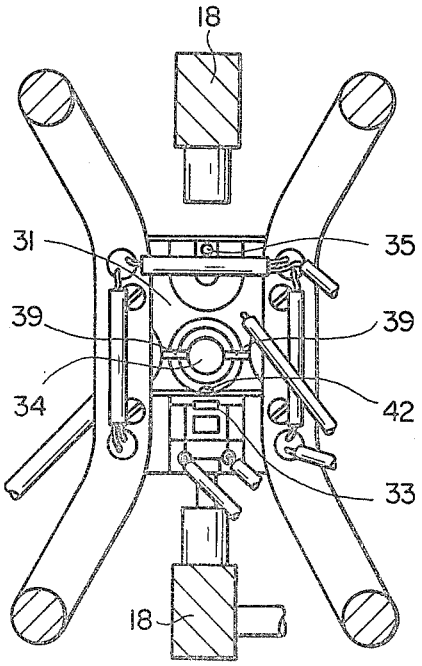
FIG. 3 is a sectional view taken along the line 3—3 of FIG. 1.

An ionizer assembly in accordance with the present invention is shown in FIGS. 1, 2 and 3. The assembly includes an ionizing section 11 mounted on flange 12. The flange provides for attaching the ionizer to the vacuum envelope 13 of associated equipment such as a mass spectrometer. Screws 14 may be employed to fasten the flange 12 to the envelope 13. A magnet control rod 16 extends through the flange and controls the position of the magnet 17 and magnet poles 18. An electric feed through 19 is connected to the flange and provides a feed through for the leads 21 which apply voltages and currents to the electrodes, electron gun, etc.

Also shown connected to the flange is a vacuum lock assembly 22. The vacuum lock assembly permits the insertion of the sample probe into the ionizer. In accordance with the present invention the vacuum lock also permits the insertion and removal of ionization chambers into the ionizing section 11. Briefly, the valve works in the following manner. A probe is inserted axially into the end 23 where it is engaged tightly by an O-ring which forms a vacuum seal. At this point the volume between the O-ring and the valve 24, which is closed, is evacuated through the tube 26. At this point the valve 24 can be opened allowing the probe to enter the envelope via the guide tube 27 to the ionizer. If the probe is a sample probe the solid sample is placed near the ionization chamber. As will be described, if an insertion and removal tool is being used it either inserts an ionization chamber into the ionizer or engages an ionization chamber for removal.

To remove the probe or tool it is withdrawn past the valve 24. The valve 24 is then closed and the tool or probe removed.

The ionizing section 11 comprises a support block 31 (FIGS. 1 and 3) which serves to support an ionization chamber of the type to be presently described. Accelerating and focusing electrodes 32, filament assembly 33 and a collector 35.

Figure 8:
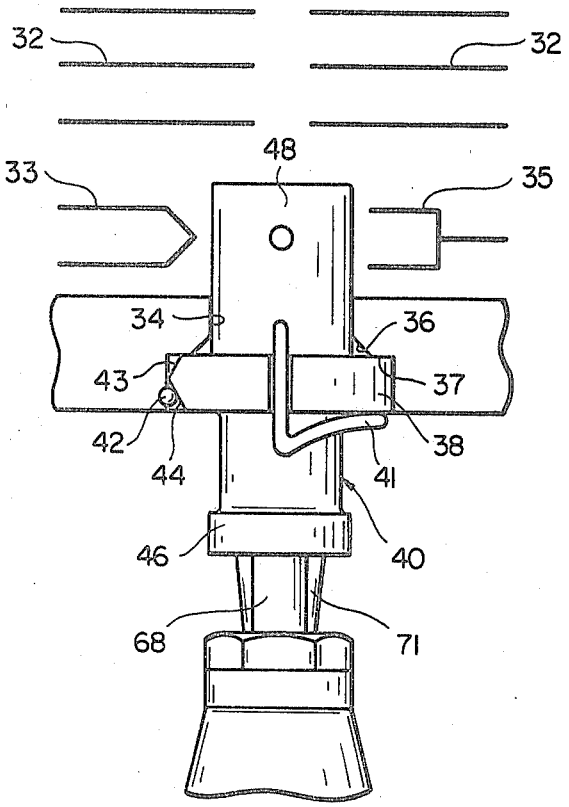
FIG. 8 is an enlarged view showing an ionization chamber assembly inserted in the ionizer in cooperative relationship with the electron source and electrodes.

The block includes a hole 34, (FIGS. 3 and 8). The hole includes a conical surface 36 which serves to guide and center an associated interchangeable ionization chamber assembly 40 as it is inserted. The hole includes stop shoulder 37 against which the rim 38 abuts to position the chamber assembly 40. Slots 39 accommodate the retaining spring 41 of the ionization chamber. A spring 42 is supported by the block and releasably engages and holds the ionization chamber assembly. Referring particularly to FIG. 8 it is seen that the rim 38 includes two caming surfaces 43 and 44. When the ionization chamber is inserted in the ionizer the surface 43 moves the spring outward. The spring then rides on the surface 44 where it forces or urges the ionization chamber into firm seating engagement with the shoulder 37 and holds the ionization chamber in the ionizer. The slots 39 and spring 41 serve to orient the ionization chamber so that the openings in the chamber are all aligned with the source block 31. The shoulder fixes the axial position so that the end of the ionization chamber is properly positioned with respect to the electrodes 32.

FIGS. 6A–6B and 7A–7B show ionization chamber assemblies in accordance with the present invention. The assembly 40 includes an adapter 46 which includes the stop rim 38. The adapter is cup shaped and hollow to receive the insertion probe to be presently described. The end may have an opening 47 through which sample enters into the ionization chamber from the sample probe. The ionization chamber or ion volume is defined by a hollow cylindrical member 48 which is accommodated by the adapter 46. The cylindrical member and adapter define a volume or ionization chamber. The cylindrical member 48 is releasably secured to the adapter by the spring 41. It is seen that the cylindrical member is inexpensive and can be removed and discarded. Thus, it is possible to maintain clean ionization volumes or chambers.

As previously described it is an object of the invention to provide an ionizer in which operation in the electron impact ionization mode or the chemical ionization mode can be optimized. The present invention permits such optimization, it is seen that by selection of the shape and configuration of the cylindrical member 48 any configuration of ion volume can be achieved.

Figure 6A:
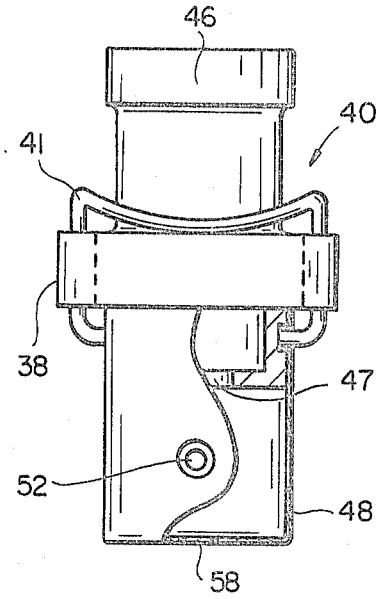
FIGS. 6A–6B are views of an ionization chamber assembly particularly suitable for chemical ionization.
Figure 6B:
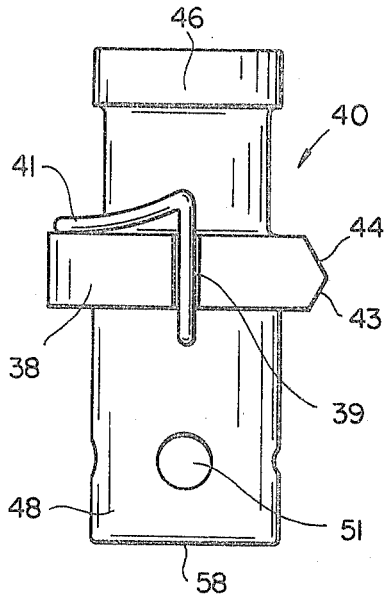
Figure 9:
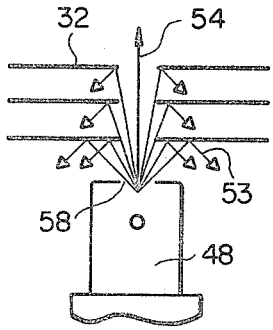
FIG. 9 illustrates the relationship of the ionization chamber and electrodes for chemical ionization.

The ionization chamber shown in FIGS. 6A–6B and 9 is particularly suitable for chemical ionization. Sample is introduced through the inlet 51 and electrons enter through the opening 52. The sample gas exits as shown schematically by the arrows 53 and ions formed in the volume travel in the direction of the arrow 54. Chemical ionization results from the ion-molecule reaction that occurs in the ion chamber between a low pressure sample gas ($\sim 10^{-6}$) and the ions of a high pressure ($\sim 1$ torr) reactant gas. The electron beam reacts primarily with the high pressure reactant gas to form ions. These ions then react with the molecules of the sample gas to form ions characteristic of the sample. The entire volume of the chamber contains ions and thus a small exit port 58 is provided from which the ions can escape into the mass analyzer.

Figure 7A:
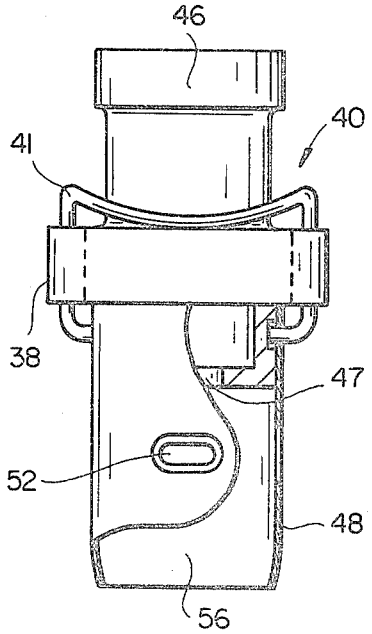
FIGS. 7A–7B are views of an ionization chamber assembly particularly suitable for electron impact ionization.
Figure 7B:
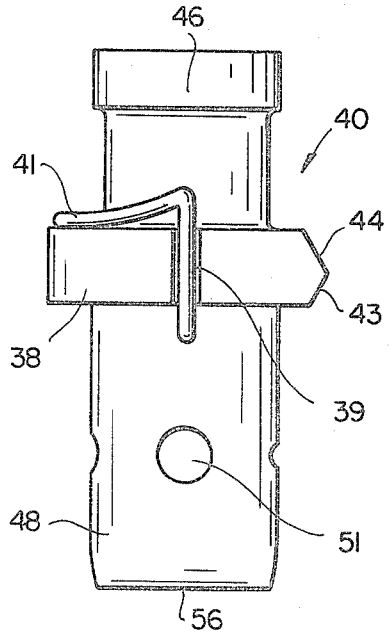
Figure 10:
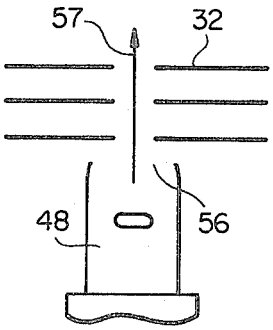
FIG. 10 illustrates the relationship of the ionization chamber and electrodes in electron impact ionization.

The ionization chamber shown in FIGS. 7A–7B and 10 is suitable for electron impact ionization. The electrons strike the sample molecules and the resultant energy exchange is sufficient to cause ionization. The exit opening 56 is large so fields from the accelerating electrode can penetrate the ion volume, which is closely adjacent, and accelerate the ions as indicated by the arrow 57, FIG. 10. The large exit opening 56 maintains low pressure ($<10^{-3}$ torr) inside the ionization chamber which is necessary for EI operation.

Thus, it is seen that by proper selection of the size and configuration of the cylindrical member 48 it is possible to optimize the operation of ionizer in either mode of operation.

Figure 4:
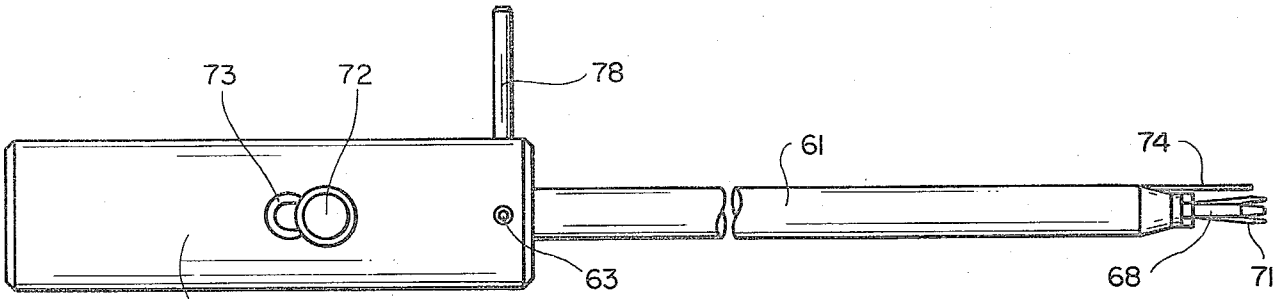
FIG. 4 is a plan view of an ionization chamber insertion and removal tool in accordance with the present invention.
Figure 5:
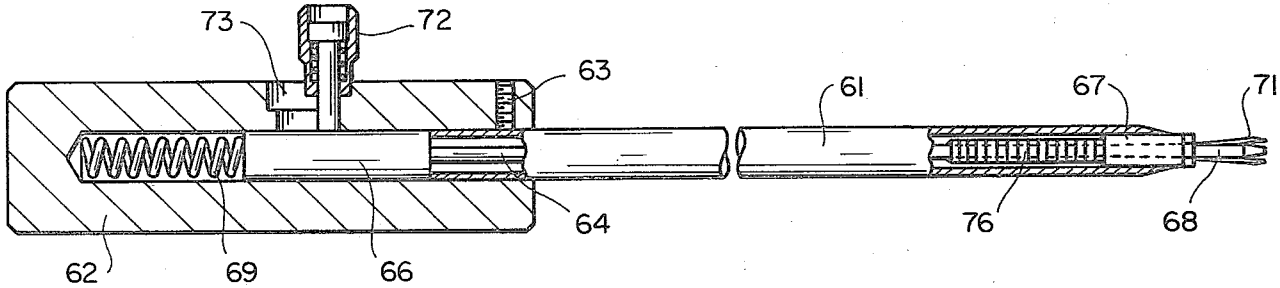
FIG. 5 is a side elevational view of the insertion and removal tool partly in section.

An ionization chamber insertion and removal tool is shown in FIGS. 4 and 5. The tool includes a hollow barrel 61 having one end secured to a handle 62 as by set screw 63. A probe 64 extends coaxially in the barrel with one end secured to support member 66. The other end is slidably received by a bushing 67 and the end 68 extends past the bushing 67 in the position shown. The probe 64 is urged toward the extended position by spring 69. Spring fingers 71 are secured to the end of the bushing 67 by suitable means. The end 68 of the probe 64 serves to spread the fingers 71. The support 66 is engaged by a handle 72. By moving the handle to compress the spring 69 the probe end 68 is retracted and the spring fingers 71 close. The probe is held in the retracted position by moving the handle into the well 73. With the fingers collapsed they can be inserted into the adapter 46. The probe is then moved to expand the fingers and the adapter 46 is securely held. A guide bracket 74 may be provided for locating the adapter cams 43, 44. In order to maintain vacuum in the system the probe and barrel must be sealed. In the present probe this is achieved by an elongated bellows 76 which has one end sealed to the probe and the other end to the bushing and barrel. The sealing may be done by welding. Thus, when the tool is inserted into the vacuum lock the volume between the probe and bellows is evacuated; the seal is then maintained as the tool is moved forward to engage an ionization chamber for removal or to insert an ionization chamber.

To assure that the tool is inserted to the proper depth for evacuation there are provided stop means. The stop means comprise in combination the pin 78 (FIGS. 1 and 4) attached to the tool handle and the grooved guide bar 79. The tool is inserted until the arm strikes the first stop 81. The volume between the probe and vacuum valve 22 is then evacuated. The tool is rotated so that the pin 78 rides along the slot until the rim 38 strikes the ledge 37 or until the probe engages the adaptor 46.

Thus, there has been provided a novel ionizer in which the ionization chambers for electron impact ionization and chemical ionization are exchangeable whereby to optimize operation in each mode. The chambers can be changed without disturbing the system vacuum. The ionization chamber is so constructed that the cylindrical member 48 is inexpensive and can be discarded thereby minimizing ionizer cleaning and maintenance.

What is claimed:

1. An ionizer adapted to be placed in a vacuum envelope for providing ions of a sample to be analyzed including (a) an electron source (b) ion accelerating and focusing electrodes (c) an interchangeable ionization chamber including an adapter and a hollow member slidably removably secured to the adapter, said hollow member including a first opening for allowing electrons to enter the chamber and an exit opening to allow ions to exit said chamber, and (d) means for receiving and supporting said ionization chamber in cooperative relationship with said electron source and accelerating and focusing electrodes whereby electrons enter said chamber through said first opening and form sample ions in the chamber which then exit the chamber through said exit opening toward said accelerating and focusing electrodes.

2. An ionizer as in claim 1 in which said exit opening is relatively small and a gas inlet opening is formed in the chamber to permit introduction of gas into said chamber and cause gas and ions to exit through the exit opening.

3. An ionizer as in claim 1 in which said exit opening is relatively large to allow electric fields from said accelerating electrode to penetrate into said chamber to accelerate ions.

4. An ionizer as in claim 1 in which said means for receiving and supporting said ionization chamber includes means for releasably retaining said ionization chamber adapter.

5. An ionizer as in claim 4 wherein said means for releasably retaining said ionization chamber and includes a seat and spring means for engaging and urging said ionization chamber into seated position.

6. An ionizer as in claim 5 in which said adapter includes a caming surface which is engaged by said spring means to urge said adapter into seated position.

7. An ionizer as in claim 1 in which said adapter includes means for releasably retaining said cylindrical member.

8. An ionizer as in claim 1 in which said hollow member is cylindrical and cup shaped.

9. An ionization chamber assembly for use in an ionizer of the type which includes means for removably receiving and holding an ionization chamber in cooperative relationship with an electron source comprising (a) a hollow cylindrical member having an open end (b) an adapter for slidably receiving the open end of said cylindrical member to define therewith an ionization chamber and (c) means for releasably holding said cylindrical member on said adapter whereby the cylindrical member can be removed and discarded.

10. An ionization chamber as in claim 9 in which said adapter includes a well for receiving an insertion and removal tool.

* * * * *